US006299037B1

(12) United States Patent
Lee

(10) Patent No.: US 6,299,037 B1
(45) Date of Patent: Oct. 9, 2001

(54) PRESS-CONTROL BOTTLE STOPPER

(75) Inventor: Alan Lee, Taipei (TW)

(73) Assignee: Vast Focus Limited, Taipei (TW)

( * ) Notice: Subject to any disclaimer, the term of this patent is extended or adjusted under 35 U.S.C. 154(b) by 0 days.

(21) Appl. No.: 09/505,481

(22) Filed: Feb. 16, 2000

(51) Int. Cl.[7] ..... B67D 3/00
(52) U.S. Cl. ..... 222/518; 222/544; 222/563
(58) Field of Search ..... 222/518, 563, 222/559, 544

(56) References Cited

U.S. PATENT DOCUMENTS 5,392,967 * 2/1995 Satomi et al. ..... 222/509
5,435,470 * 7/1995 Kim ..... 222/509
5,495,966 * 3/1996 Won ..... 222/508
5,842,612 * 12/1998 Won ..... 222/509
5,944,235 * 8/1999 Won ..... 222/506

* cited by examiner

*Primary Examiner*—Kevin Shaver
*Assistant Examiner*—F. C Nicolas
(74) *Attorney, Agent, or Firm*—Pro-Techtor International Services

(57) ABSTRACT

A press-control bottle stopper includes a hollow stopper shell fastened to the bottleneck of the body of a bottle, the stopper shell having an axial bottom hole and a water outlet for enabling liquid to pass out of the bottle, a hollow lining member mounted inside the stopper shell, the lining having a bottom center through hole axially aligned with the axial bottom hole on the stopper shell, a plug coupled to the bottom center through hole on the lining and axially moved to close/open the water outlet, spring means, which holds the plug in the close position, and control unit controlled by hand to move the plug between the close position and the open position.

1 Claim, 9 Drawing Sheets

PRESS-CONTROL BOTTLE STOPPER

BACKGROUND OF THE INVENTION

The present invention relates to a bottle stopper for bottle, and more particularly to a press-control bottle stopper, which enables the user to close/open the outlet of the bottle by means of a pressing operation.

In order to stop liquid from leaking out of a bottle container or to prevent contact of outside air with liquid in a bottle container, a matched bottle cap shall be used. Screw joint is a common design for enabling a bottle cap to be fastened to a bottle container. When picking up liquid from a bottle container, the bottle cap must be opened at first. After each service, the bottle cap must be closed on the bottle container again. When the bottle cap is removed from the bottle container, it may fall to the floor and contaminated with dirt. There are also known a bottle cap comprising a cap body for fastening to the bottleneck of a bottle container, the cap body having a center through hole, and a plug hinged to the cap body for plugging into the center through hole on the cap body to stop the passage. The plug and the cap body are formed integral with each other, and injection-molded from plastics. This structure of bottle cap is still not satisfactory in function because the hinged portion between the plug and the cap body tends to be broken when opening the plug from the cap body.

SUMMARY OF THE INVENTION

The present invention has been accomplished to provide a press-control bottle stopper, which eliminates the aforesaid problems. It is therefore the main object of the present invention to provide a press-control bottle stopper, which enables the user to close/open the outlet of the bottle by means of a pressing operation. According to the preferred embodiment of the present invention, the press-control bottle stopper is installed in the bottle neck of the bottle body of a bottle to close the passage of the bottle neck of the bottle body, comprising a hollow stopper shell, the stopper shell comprising a tubular coupling means fastened to the bottle neck of the bottle body, at least one water outlet for guiding liquid out of the bottle body, and an axial hole disposed at the center of a bottom side thereof, a plug installed in the stopper shell and moved between a close position and an open position to close/open the at least one water outlet, the plug comprising a plug stem inserted into the axial hole on the bottom side of the stopper shell, a spring member mounted on the plug stem inside the stopper shell to hold the plug head in the close position, and a plug head formed integral with one end of the plug stem and moved with the plug stem to close/open the at least one water outlet, a vessel-like hollow lining mounted inside the hollow stopper shell, the lining comprising a coupling portion fastened to an internal part of the hollow stopper shell, and a bottom center through hole axially aligned with the axial hole on the bottom side of the hollow stopper shell, a water passage defined within an inside wall of the hollow stopper shell around the periphery of the lining and disposed in communication with the at least one water outlet, and a control unit coupled to the inside of the vessel-like hollow lining and operated to close/open the at least one water outlet, the control unit comprising a hollow base press-fitted into the vessel-like hollow lining, a press-button mounted in the hollow base and moved axially relative to the hollow base, a push member coupled to the press-button at a bottom side and stopped against the plug stem of the plug for enabling the plug to be moved to the open position when the press-button is pressed by the user with the hand, and a release control member mounted in the hollow base and moved axially to release the push member from the plug for enabling the plug to be returned to the close position by the spring power of the spring member.

DETAILED DESCRIPTION OF THE PREFERRED EMBODIMENT

Figure 1:
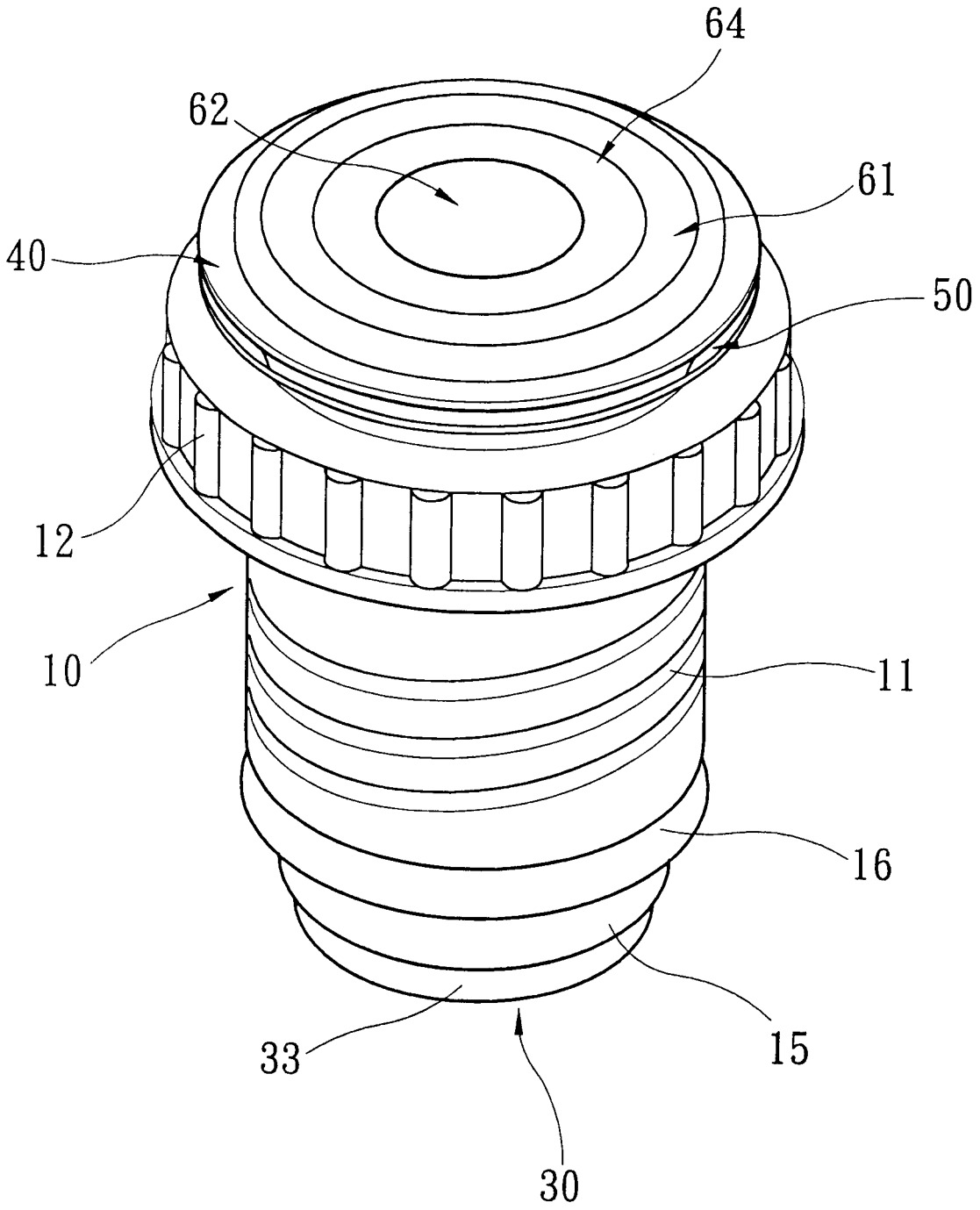
FIG. 1 is an elevational view of a press-control bottle stopper according to the present invention.
Figure 2:
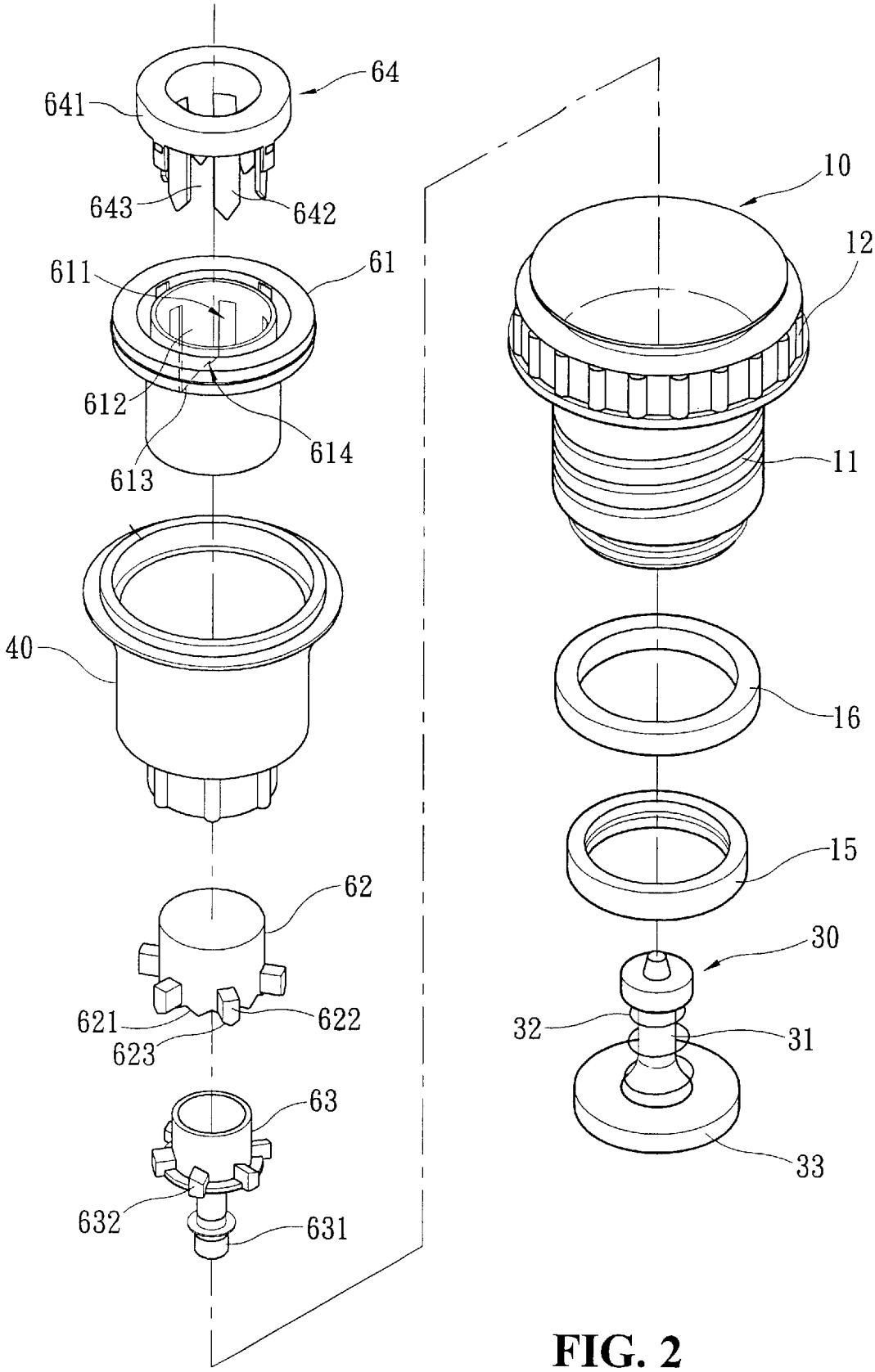
FIG. 2 is an exploded view of the press-control bottle stopper according to the present invention.

Referring to FIGS. from 1 through 4, a bottle stopper in accordance with the present invention is generally comprised of a hollow stopper shell 10, a plug 30, a lining 40, and a control unit. The stopper shell 10 comprises a tubular, externally threaded shank 11 for coupling to the bottle neck of the body of a bottle 20, a head 12 through which the stopper shell 10 is rotated and fastened to the bottle body 20 by hand, a water outlet 13 and an axial hole 14 respectively disposed at the bottom side thereof. The plug 30 comprises a plug stem 31 inserted into the axial hole 14 on the bottom side of the stopper shell 10, a spring member 32 mounted on the plug stem 31 inside the stopper shell 10, and a plug head 33 formed integral with one end of the plug stem 31. The plug head 33 is maintained in close contact with the bottom side of the stopper shell 10 due to the effect of the spring power of the spring member 32, causing the water outlet 13 to be closed. The lining 40 is a vessel-like hollow member mounted inside the stopper shell 10, having a coupling portion 41 fastened to an internal part of the stopper shell 10 by, for example, a screw joint, and a bottom center through hole 42 axially aligned with the axial hole 14 on the bottom side of the stopper shell 10. After installation of the lining 40 in the stopper shell 10, a water passage 50 is defined within the inside wall of the stopper shell 10 around the outside wall of the lining 40. The aforesaid control unit is coupled to the inside of the lining 40, comprised of a hollow base 61 press-fitted into the lining 40, a press-button 62 axially movably mounted in the hollow base 61, a push member 63 coupled to the press-button 62 at the bottom side, and a release control member 64. The push member 63 is stopped against the plug stem 31 of the plug 30. Pressing the press-button 62 causes the push member 63 to lower the plug 30, and therefore the water outlet 13 is opened. The release control member 64 is mounted in the hollow base 61, and moved axially to release the push member 63 from the plug 30, enabling the plug 30 to return to its former close position where the plug head 33 stops the water outlet 13.

As indicated above, the plug head 33 closes the water outlet 13, preventing liquid from flowing out of the bottle body 20 through the water outlet 13. In order to stop liquid from leaking into the water passage 50 through the gap between the plug head 33 and the bottom side of the stopper shell 10, a first non-toxic, flexible rubber (or plastic) water seal ring 15 is fastened to the bottom side of the stopper shell 10 to bear the plug head 33 of the plug 30. Further, in order to stop liquid from leaking out of the bottle body 20 through the gap between the stopper shell 10 and the bottle body 20, a second non-toxic, flexible rubber (or plastic) water seal ring 16 is mounted on the periphery of the stopper shell 10 and disposed in close contact with the inside wall of the bottle body 20.

By means of the control unit, the plug 30 is moved between the close position where the plug head 33 stops the water outlet 13 and the open position where the plug head 33 is opened from the water outlet 13. The position change of the plug 30 is controlled by means of a simple finger pressing operation. The detailed structure of each member of the control unit is respectively described hereinafter. The hollow base 61 comprises an axially extended center round hole 611, and a plurality of longitudinal guide rails 612 equiangularly spaced around the center round hole 611. Each guide rail 612 has a beveled bottom guide edge 613 and a retaining notch 614 in the middle of the beveled bottom guide edge 613. The release control member 64 is inserted into the center round hole 611 in the hollow base 61, comprising an annular head 641, a plurality of guide strips 642 axially downward extended from the bottom side of the annular head 641, and a plurality of actuating spaces 643 respectively defined between each two adjacent guide strips 642. The release control member 64 can be moved axially relative to the hollow base 61 between a first position where the annular head 641 of the release control member 64 is disposed in flush with the top side wall of the hollow base 61, and a second position where the annular head 641 of the release control member 64 is disposed above the elevation of the top sidewall of the hollow base 61. The press-button 62 is a cap-like member inserted through the annular head 641 of the release control member 64, having a serrated bottom edge 621, and a plurality of radial blocks 622 equiangularly spaced around the periphery near the serrated bottom edge 621 and respectively radially inserted through the actuating spaces 643. The push member 63 is coupled to the press-button 62, having a plurality of radial blocks 632 equiangularly spaced around the periphery and a bottom rod 631 stopped against the plug stem 31 of the plug 30.

Figure 3:
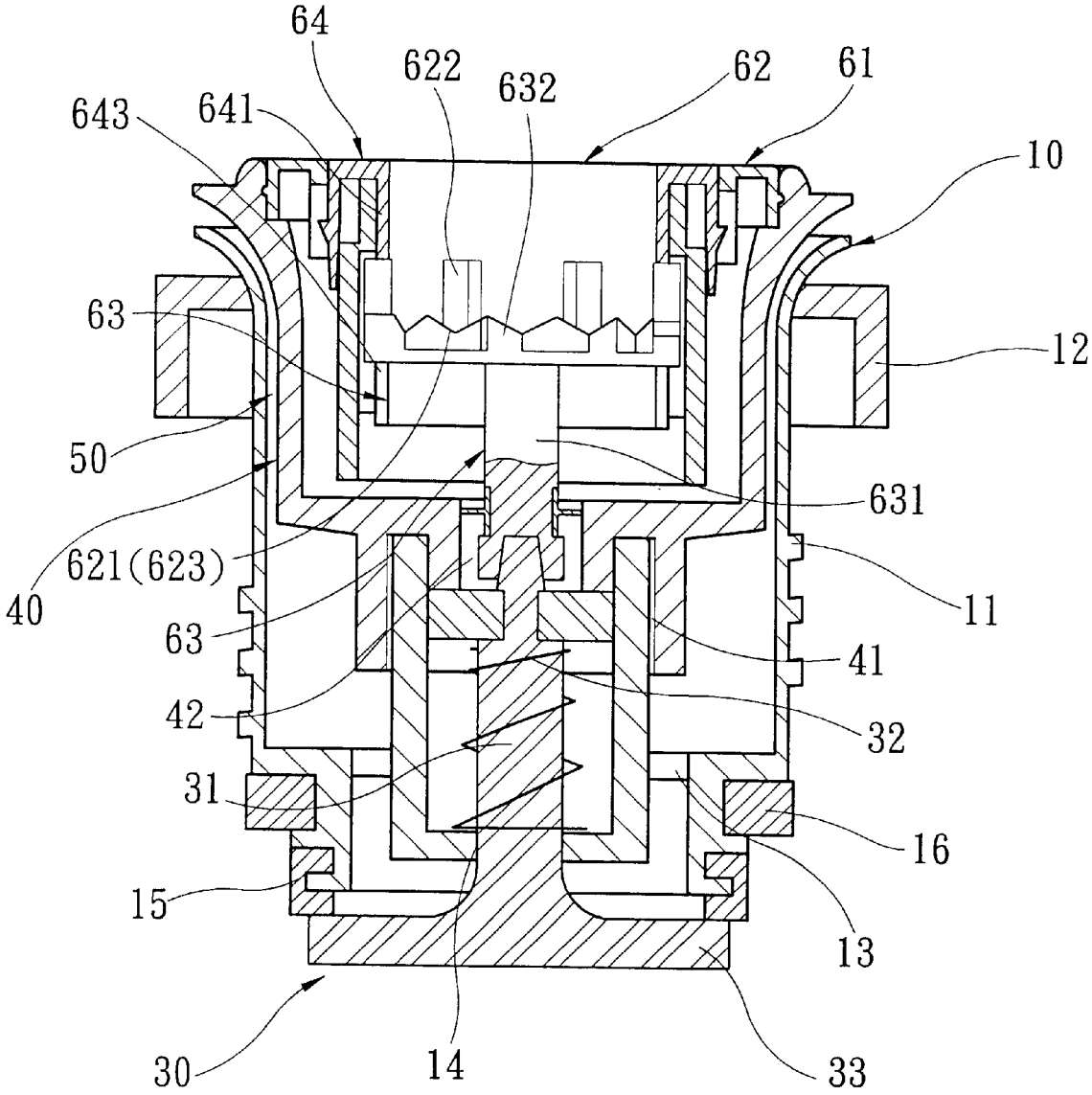
FIG. 3 is a sectional assembly view of the press-control bottle stopper according to the present invention.
Figure 4:
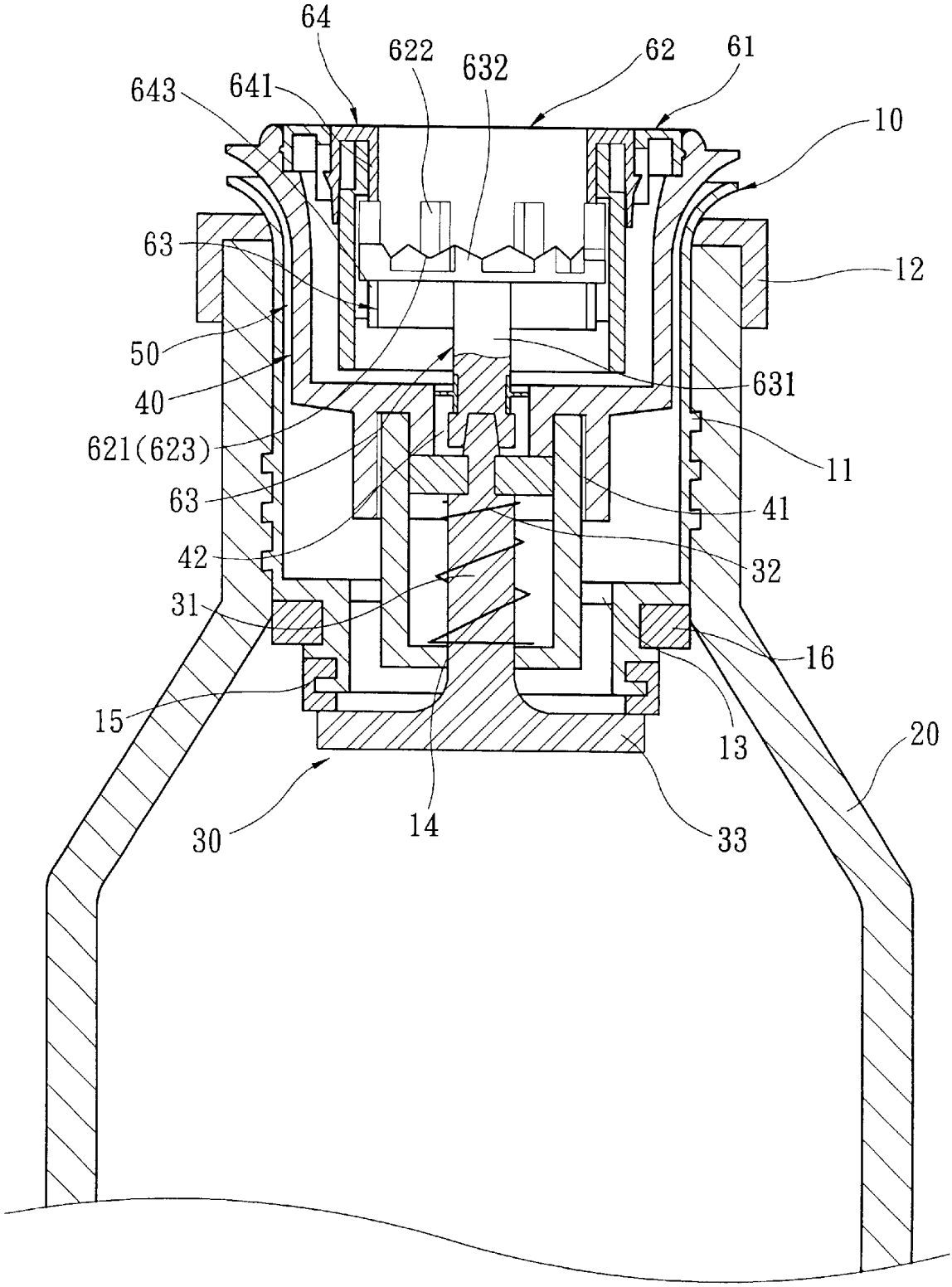
FIG. 4 is a sectional view showing the press-control bottle stopper installed in the bottleneck of the body of a bottle according to the present invention.
Figure 5A:
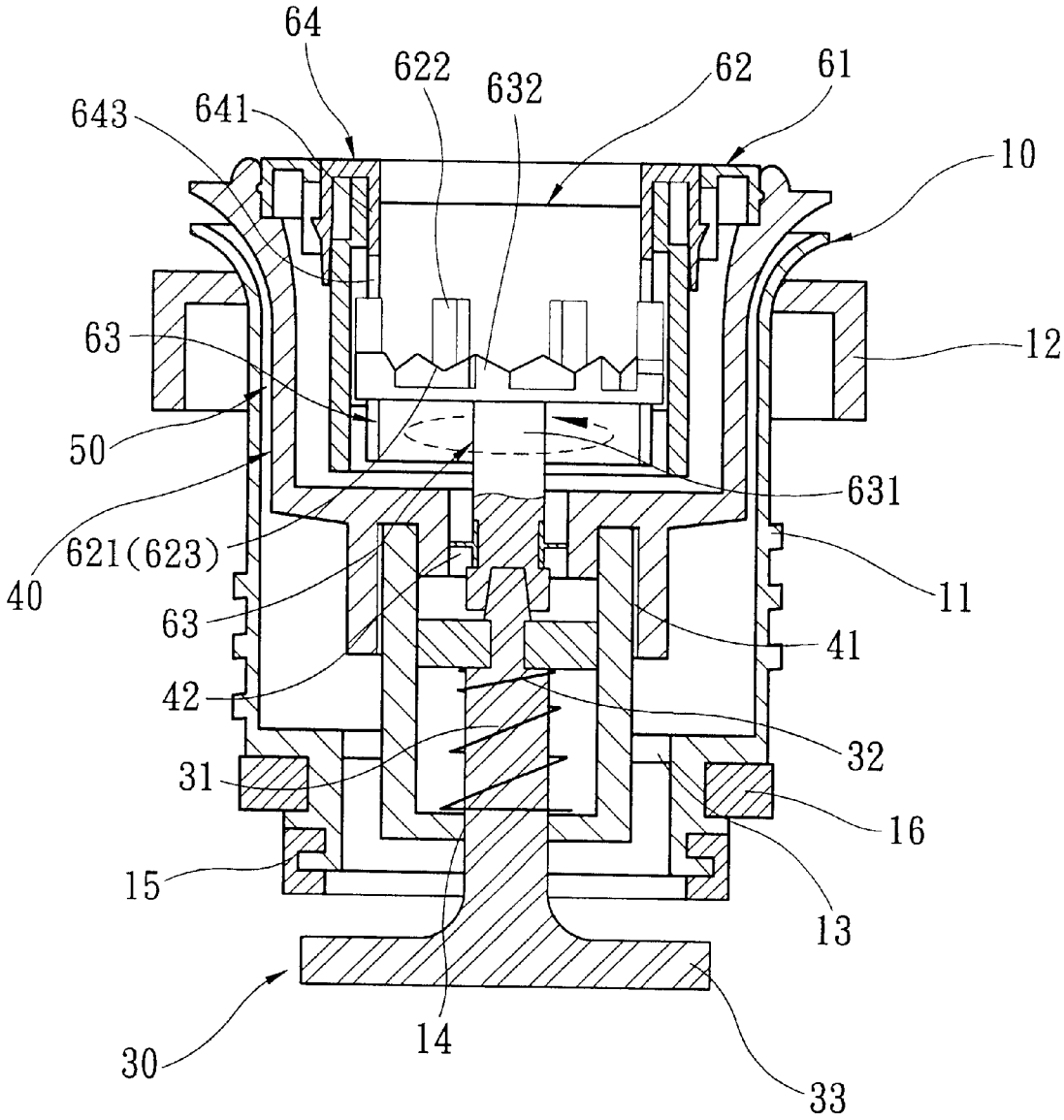
FIG. 5A is a sectional view of the present invention showing the press button depressed and rotated, the plug moved to the open position.
Figure 5B:
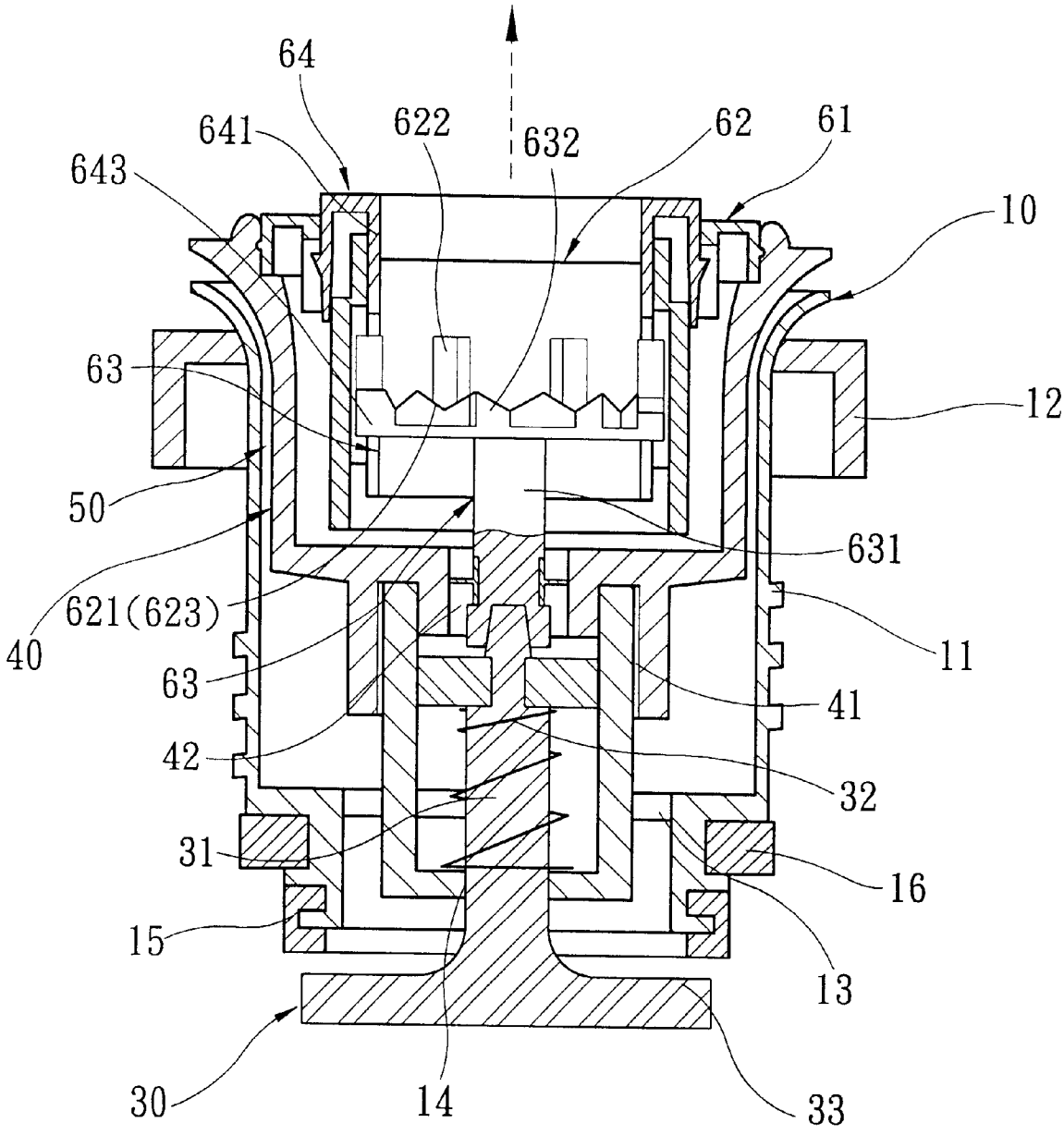
FIG. 5B is a sectional view of the present invention, showing the plug retained in the open position, the release control member moved upwards.

Referring to FIGS. 5A and 5B and FIG. 3 again, when the press-button 62 is depressed (see FIG. 5A), the radial blocks 632 of the push member 63 are lowered and moved along the beveled bottom guide edge 613 of each guide rail 612 into engagement with the retaining notch 614 on the bottom guide edge 613 of each guide rail 612 respectively to hold the plug 30 in the open position, keeping the plug head 33 opened from the water outlet 13. When the release control member 64 is depressed at this time, the guide strips 642 are lowered to push the radial blocks 632 of the push member 63 away from the retaining notch 614 on each guide rail 612, enabling the radial blocks 632 to be moved with the push member 63 along the beveled bottom guide edge 613 of each guide rail 612 into the actuating space 643, and therefore the plug 30 is forced back to its former close position by the spring power of the spring member 32. When returned, the plug head 33 closes the water outlet 13 again.

Figure 6A:
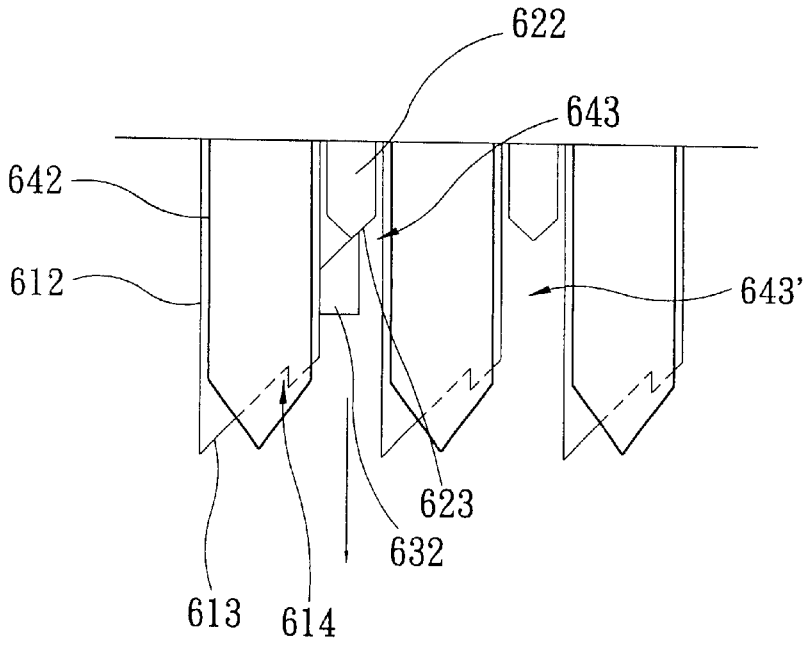
FIG. 6A is a schematic drawing showing the position of the push member relative to the release control member and the hollow base (I).
Figure 6B:
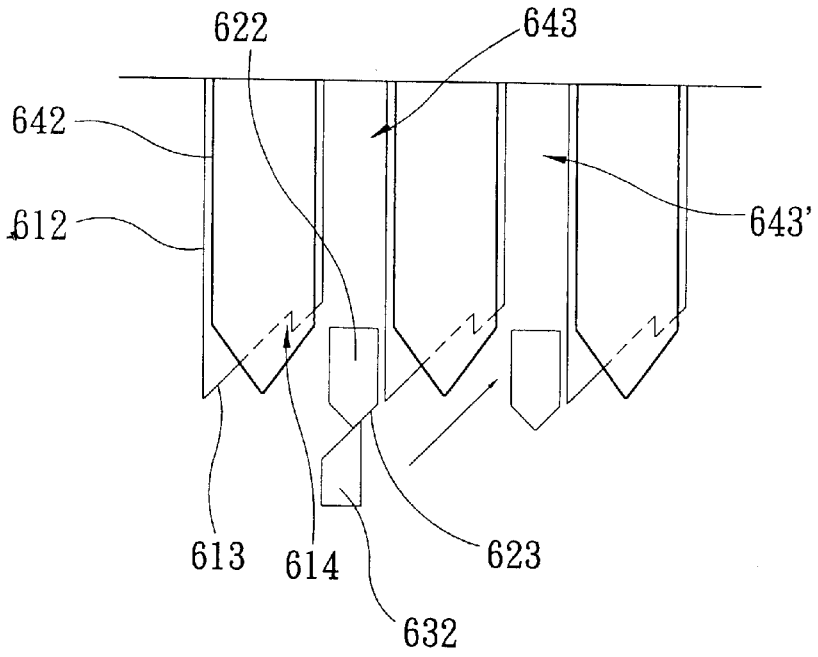
FIG. 6B is a schematic drawing showing the position of the push member relative to the release control member and the hollow base (II).
Figure 6C:
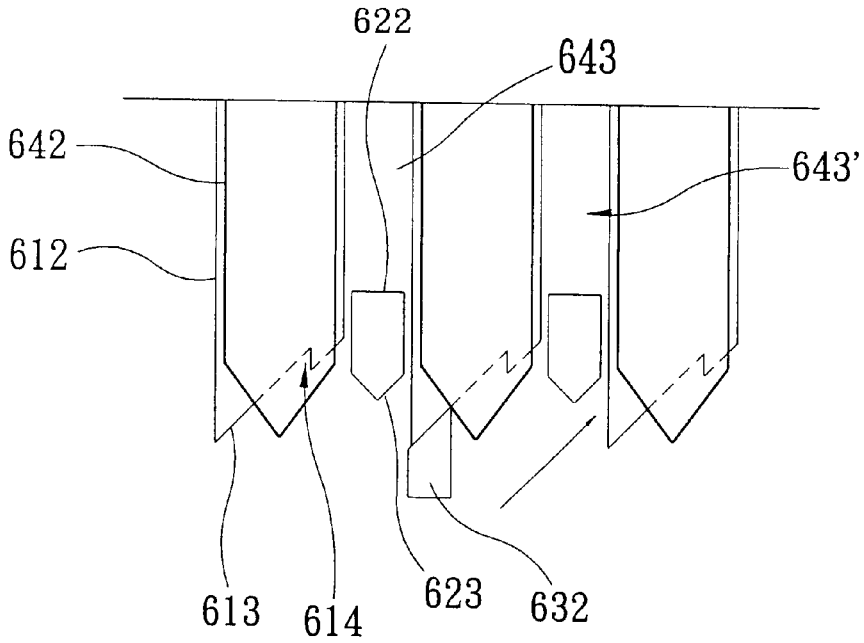
FIG. 6C is a schematic drawing showing the position of the push member relative to the release control member and the hollow base (III).
Figure 6D:
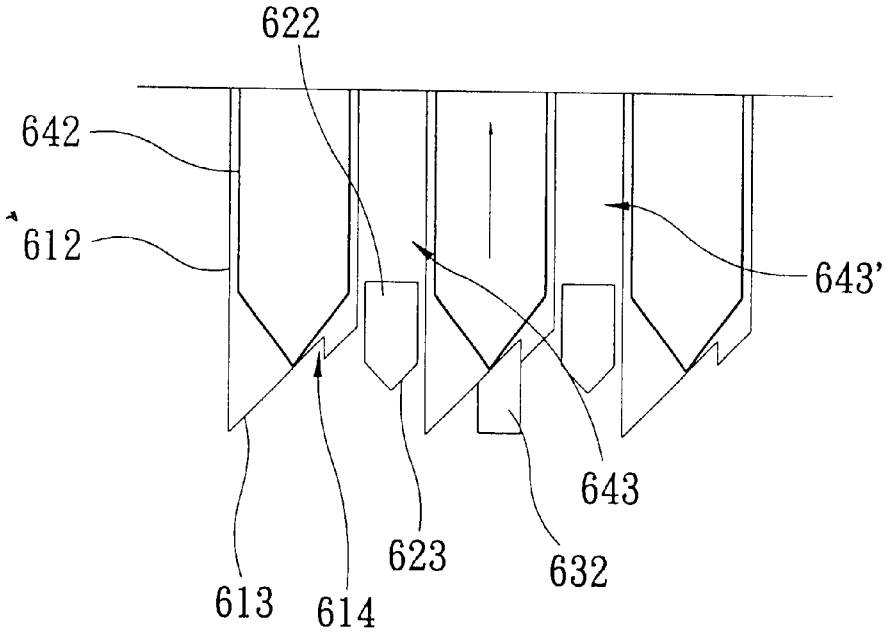
FIG. 6D is a schematic drawing showing the position of the push member relative to the release control member and the hollow base (IV).
Figure 6E:
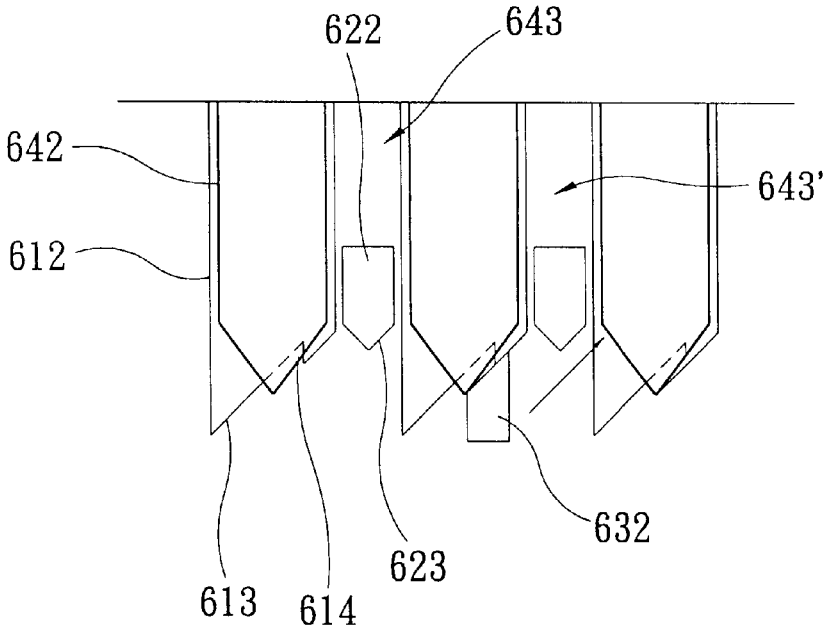
FIG. 6E is a schematic drawing showing the position of the push member relative to the release control member and the hollow base (V).
Figure 6F:
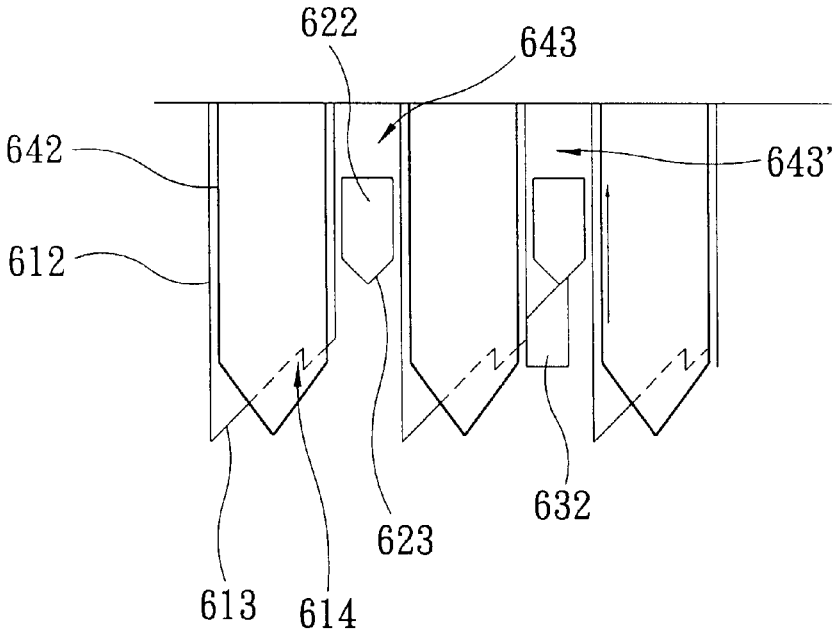
FIG. 6F is a schematic drawing showing the position of the push member relative to the release control member and the hollow base (VI).

FIGS. from 6A through 6F show the operation of the control unit. FIG. 6A shows the position of the control unit when not operated. This position is the close position shown in FIG. 3, where the push member 63 is pushed upwards by the spring member 32, and the radial blocks 622 of the press button 62 are moved to the upper limit position in the actuating spaces 643. When the press-button 62 is depressed to lower the push member 63 to the position shown in FIG. 6B, the radial blocks 632 are moved along the beveled bottom guide edges as shown in FIG. 6C. If the downward pressure is released from the press button 62 at this time, the radial blocks 632 are respectively forced into engagement with the retaining notch 614 on the beveled bottom guide edge 613 of each guide rail 612 as shown in FIG. 6D, enabling the release control member 64 to be pushed upward to the position shown in FIG. 5B. At this time, the push member 63 forces the spring member 32, causing the plug 30 to be maintained in the open position, and therefore liquid is allowed to be powered out of the bottle body 20 through the water outlet 13 and the water passage 50. When the release control member 64 is depressed as shown in FIG. 6E, the radial blocks 632 of the push member 63 are forced away from the retaining notch 614 on the beveled bottom guide edge 613 of each guide rail 611, enabling each radial block 632 to be shifted to another actuating space 643', and therefore the plug head 33 is returned with the plug 30 to the close position to close the water outlet 13 again.

As indicated, the bottle body 20 can be closed/opened simply by means of pressing the press-button 62 or the release control member 64.

While only one embodiment of the present invention has been shown and described, it will be understood that various modifications and changes could be made thereunto without departing from the spirit and scope of the invention disclosed.

What the invention claimed is:

1. A press-control bottle stopper installed in a bottle neck of a bottle body of a bottle to close a passage of the bottle neck of the bottle body, comprising:

a hollow stopper shell, said stopper shell comprising a tubular coupling means fastened to the bottle neck of the bottle body, at least one water outlet for guiding liquid out of the bottle body, and an axial hole disposed at the center of a bottom side thereof;

a plug installed in said stopper shell and moved between a closed position and an open position to close and open said at least one water outlet, said plug comprising a plug stem inserted into said axial hole on said bottom side of said stopper shell, a spring member mounted on said plug stem inside said stopper shell to hold said plug in said closed position, and a plug head formed integral to one end of said plug stem and moved with said plug stem to close and open said at least one water outlet;

a hollow lining mounted inside said hollow stopper shell, said lining comprising a coupling portion fastened to an internal part of said hollow stopper shell, and a bottom center through hole axially aligned with said axial hole on said bottom side of said hollow stopper shell;

a water passage defined within an inside wall of said hollow stopper shell around a periphery of said lining and disposed in communication with said at least one water outlet; and a control unit coupled to an inside of said hollow lining and operated to close and open said at least one water outlet, said control unit comprising a hollow base press-fitted into said hollow lining, a press-button mounted in said hollow base and moved axially relative to said hollow base, a push member coupled to said press-button at a bottom side and stopped against said plug stem of said plug for enabling said plug to be moved to said open position when said press-button is pressed by the user with the hand, and a release control member mounted in said hollow base and moved axially to release said push member from said plug for enabling said plug to be returned to said closed position by the spring power of said spring member; wherein said hollow base of said control unit comprises an axially extended center round hole and a plurality of longitudinal guide rails equiangularly spaced around said center round hole, said guide rails each having a beveled bottom guide edge and a retaining notch in a middle of said beveled bottom guide edge; said release control member of said control unit is inserted into said center round hole in said hollow base and moved axially relative to said hollow base between a first position where an annular head of said release control member is disposed flush with said hollow base, and a second position where said annular head of said release control member is disposed above an elevation of said hollow base, said release control member comprising said annular head, a plurality of guide strips axially downward extended from said annular head, and a plurality of actuating spaces respectively defined between each two said adjacent guide strips; said press-button of said control unit is inserted through said annular head of said release control member, said press-button of said control unit having a serrated bottom edge, and a plurality of radial blocks equiangularly spaced around a periphery thereof near said serrated bottom edge and radially inserted through the actuating space between each two adjacent guide strips of said release control member; said push member of said control unit is coupled to said press-button, having a plurality of radial blocks equiangularly spaced around a periphery thereof, and a bottom rod stopped against said plug stem of said plug; thereby enabling said radial blocks of said push member to be lowered and moved along said beveled bottom guide edge of each guide rail of said hollow base into engagement with said retaining notch on said bottom guide edge of each guide rail of said hollow base respectively to hold said plug in said open position when said press-button is depressed, and for enabling said guide strips of said release control member to push said radial blocks of said push member away from said retaining notch on each guide rail of said hollow base and to let said radial blocks of said push member be moved with said push member along said beveled bottom guide edge of each guide rail of said hollow base into the actuating space between each two guide strips of said release control member when said release control member is depressed, so as to let said plug be forced back to said closed position by the spring power of said spring member.

* * * * *